US010607591B1

(12) United States Patent
Kao et al.

(10) Patent No.: US 10,607,591 B1
(45) Date of Patent: Mar. 31, 2020

(54) SOUND PLAYBACK DEVICE AND METHOD FOR MASKING INTERFERENCE SOUND THROUGH NOISE MASKING SIGNAL THEREOF

(71) Applicant: Unlimiter MFA Co., Ltd., Eden Island, SC (US)

(72) Inventors: Kuo-Wei Kao, Taipei (TW); Cheng-Te Wang, Taipei (TW); Yu-Chieh Huang, Taipei (TW); Wei-Lin Chang, Taipei (TW); I-Ting Lee, Taipei (TW); Kuo-Ping Yang, Taipei (TW)

(73) Assignee: UNLIMITER MFA CO., LTD., Eden Island (SC)

( * ) Notice: Subject to any disclaimer, the term of this patent is extended or adjusted under 35 U.S.C. 154(b) by 0 days.

(21) Appl. No.: 16/705,332

(22) Filed: Dec. 6, 2019

(30) Foreign Application Priority Data

Aug. 6, 2019 (TW) ..... 108127949 A

(51) Int. Cl.
*H04R 3/02* (2006.01)
*G10K 11/175* (2006.01)
*G10L 25/51* (2013.01)

(52) U.S. Cl.
CPC ..... *G10K 11/175* (2013.01); *G10L 25/51* (2013.01)

(58) Field of Classification Search
CPC ..... G10K 11/175
USPC ..... 381/73.1
See application file for complete search history.

(56) References Cited

U.S. PATENT DOCUMENTS 8,976,975 B2 * 3/2015 Loud ..... H03G 3/32 381/71.8

* cited by examiner

*Primary Examiner* — Rasha S Al Aubaidi
(74) *Attorney, Agent, or Firm* — Bacon & Thomas, PLLC

(57) ABSTRACT

A sound playback device and a method for masking interference sound through a noise masking signal thereof are disclosed. The method comprises the steps of: playing an audio signal as a noise masking signal; receiving an ambient sound; analyzing whether the ambient sound has an interference sound in N different frequency bands; if so, finding at least one interference sound frequency band and a time period, and the interference sound conforms to the condition that an instant sound entropy value is greater than a dynamic sound average entropy value, wherein the instant sound entropy value is the calculated sound entropy value in a current sampling time; the dynamic sound average entropy value is an average entropy value of the sum of the previous instant sound entropy values; and increasing an energy of the noise masking signal in the interference sound frequency band and the time period.

8 Claims, 6 Drawing Sheets

SOUND PLAYBACK DEVICE AND METHOD FOR MASKING INTERFERENCE SOUND THROUGH NOISE MASKING SIGNAL THEREOF

BACKGROUND OF THE INVENTION

1. Field of the Invention

The present invention relates to a sound playing device and a method for masking an interference sound through a noise masking signal, and in particular, the invention relates to a sound playback device and a method for masking the interference sound through a noise masking signal for calculating the disorder value (entropy) of different frequency bands of an environmental sound, analyzing the information content and the degree of interference of the noise, and determining whether the interference sound is present.

2. Description of the Related Art

Users often need to concentrate on one single thing, or they just want to rest or even sleep and do not want to be disturbed by outside noise. In the prior art, white noise (such as the sound of waves, rain, wind, etc.) can be used to mask external interference sounds (such as the sounds of babies crying, car horns, human speech, etc.). However, in the prior art, the noise masking signals are mostly limited to the use of white noise with little variation. It will better suit a user's needs to use the favorite music of the user as the noise masking signal. More importantly, the prior art can only adjust the volume of white noise according to the energy change of the ambient sound. The white noise will mask all ambient sounds, including background noise with low information content (low entropy), such as the sound of a fan, an air conditioner, etc., and background noise with high information content (high entropy), such as interference sound that can be distracting to the user. In fact, only the interference sound needs to be masked. The prior art does not calculate the information content and the degree of interference by calculating the ambient sound disorder value (entropy), nor does it judge whether the interference sound exists or not. Therefore, the prior art fails to adjust the noise masking signal according to the real interference sound. As a result, the white noise played to mask the interference sound is often too high in energy to provide efficient noise masking, and the white noise itself becomes a kind of noise.

Therefore, it is necessary to propose a new sound playback device and a method for masking interference sound through a noise masking signal to solve the deficiencies of the prior art.

SUMMARY OF THE INVENTION

It is an object of the present invention to provide a sound playback device which can analyze a sound disorder value (entropy) of different frequency bands of an ambient sound, analyze the information content of the noise and the degree of interference, and determine whether the interference sound exists.

It is another object of the present invention to provide a method for masking interference sound through a noise masking signal for use in the sound playback device.

In order to achieve the above objects, the present invention provides a sound playback device for a user to use in an environment having an interference sound. The sound playback device comprises a speaker module, a sound receiving module, a computing module, and a sound processing module. The speaker module is provided for playing an audio signal as a noise masking signal. The sound receiving module is provided for receiving an ambient sound of the environment. The computing module is electrically connected to the sound receiving module and provided for analyzing whether the ambient sound has the interference sound in N different frequency bands; if so, finding at least one interference sound frequency band and a time period, wherein $5 \leq N \leq 1000$ and the interference sound conforms to an instant sound entropy value greater than a dynamic sound average entropy value, wherein the instant sound entropy value is the calculated sound entropy value in a current sampling time, wherein the sampling time is between 0.1 seconds and 2 seconds, and the dynamic sound average entropy value is an average entropy value of the sum of the previous instant sound entropy values. The sound processing module is electrically connected to the computing module and the speaker module for increasing an energy of the noise masking signal in the interference sound frequency band and the time period, causing the speaker module to amplify the energy of the noise masking signal in the interference sound frequency band and the time period.

The present invention provides a method for masking an interference sound through a noise masking signal, comprising the following steps: playing an audio signal as the noise masking signal; receiving an ambient sound of the environment; analyzing whether the ambient sound has the interference sound in N different frequency bands; if so, finding at least one interference sound frequency band and a time period, wherein $5 \leq N \leq 1000$, and the interference sound conforms to an instant sound entropy value greater than a dynamic sound average entropy value, wherein the instant sound entropy value is the calculated sound entropy value in a current sampling time, wherein the sampling time is between 0.1 seconds and 2 seconds, and the dynamic sound average entropy value is an average entropy value of the sum of the previous instant sound entropy values; and increasing an energy of the noise masking signal in the interference sound frequency band and the time period.

DETAILED DESCRIPTION OF THE PREFERRED EMBODIMENT

In order to make the structure and characteristics as well as the effectiveness of the present invention further understood and recognized, the detailed description of the present invention is provided as follows along with embodiments and accompanying figures.

Figure 1:
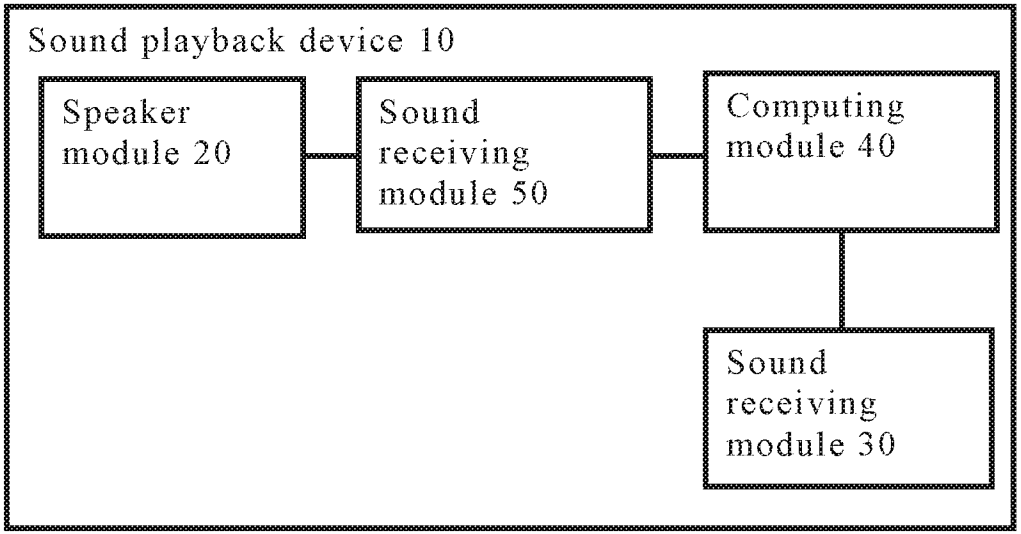
FIG. 1 illustrates a structural view of a sound playback device of the present invention.

Please refer to FIG. 1, which illustrates a structural view of a sound playback device of the present invention.

The sound playback device 10 of the present invention is provided for a user to use in an environment having an interference sound, in which the sound playback device 10 plays an audio signal to mask noise in the environment. The sound playback device comprises a speaker module 20, a sound receiving module 30, a computing module 40, and a sound processing module 50. The speaker module 20 can be a speaker for playing an audio signal as a noise masking signal. The audio signal may be white noise (such as the sound of sea waves, rain, wind, etc.) or other music, but the present invention is not limited thereto. The sound receiving module 30 can be a microphone for receiving an ambient sound S1 of the environment. The computing module 40 is electrically connected to the sound receiving module 30 for analyzing whether the ambient sound has the interference sound in N different frequency bands, wherein N can be greater than or equal to 5 but less than or equal to 1000, but the present invention does not limit the number of frequency band splits.

Figure 2:
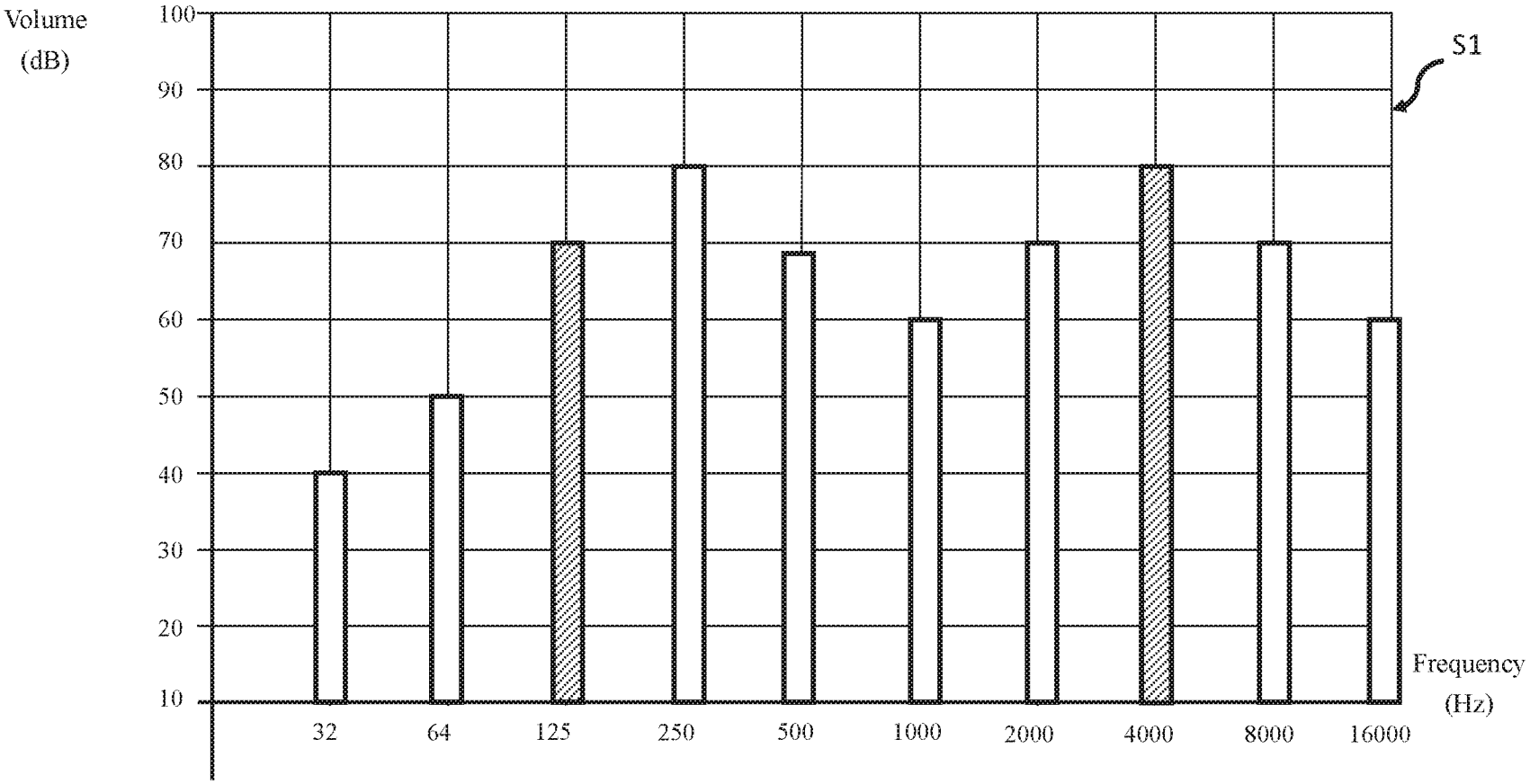
FIG. 2 illustrates a schematic diagram of the frequency spectrum of ambient sound in different frequency bands of an embodiment of the present invention.
Figure 3A:
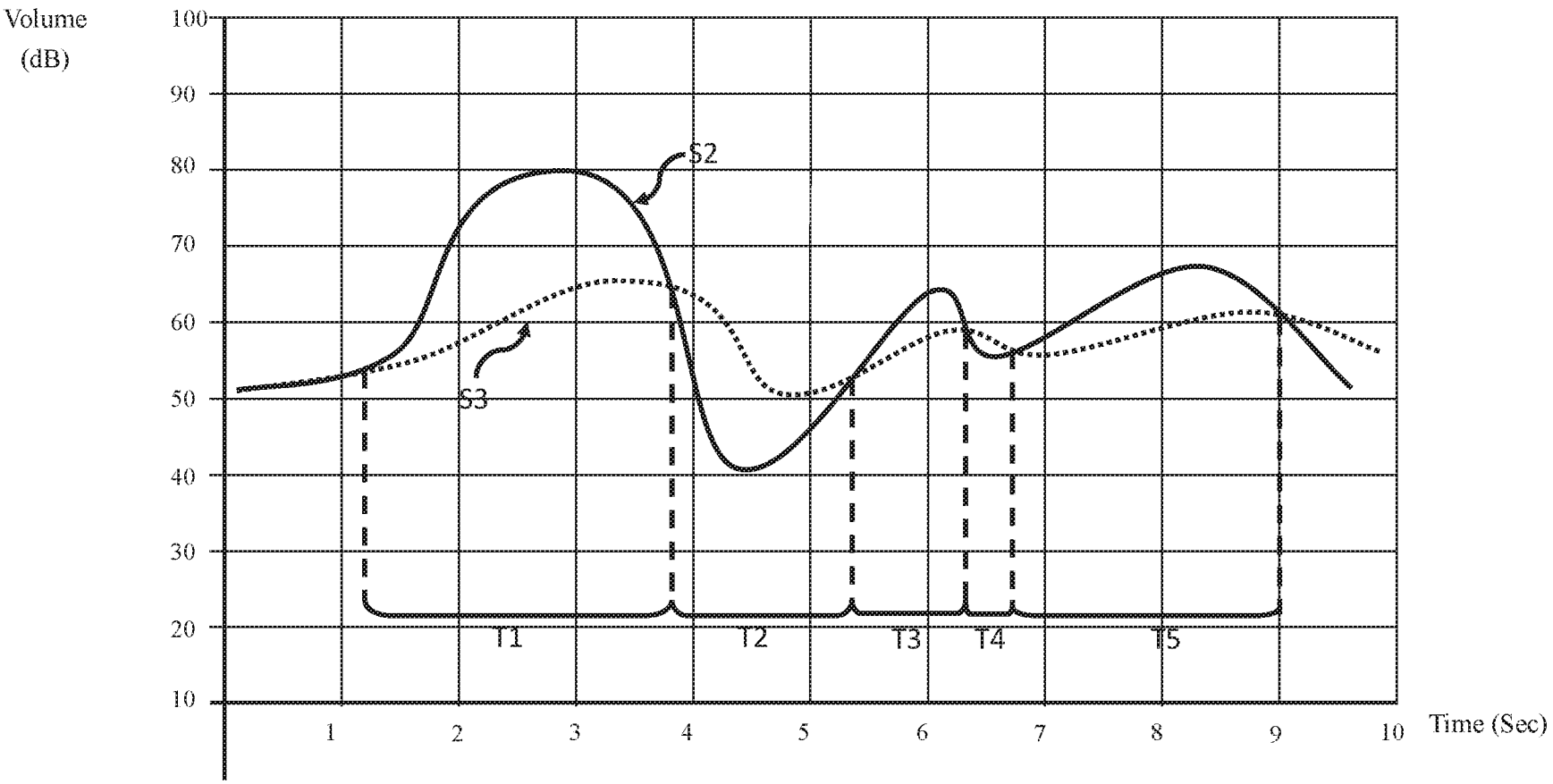
FIG. 3A is according to FIG. 2 and illustrates a schematic diagram showing the energy of the instant sound entropy value and the dynamic sound average entropy value of the ambient sound in a frequency band of 125 Hz.
Figure 3B:
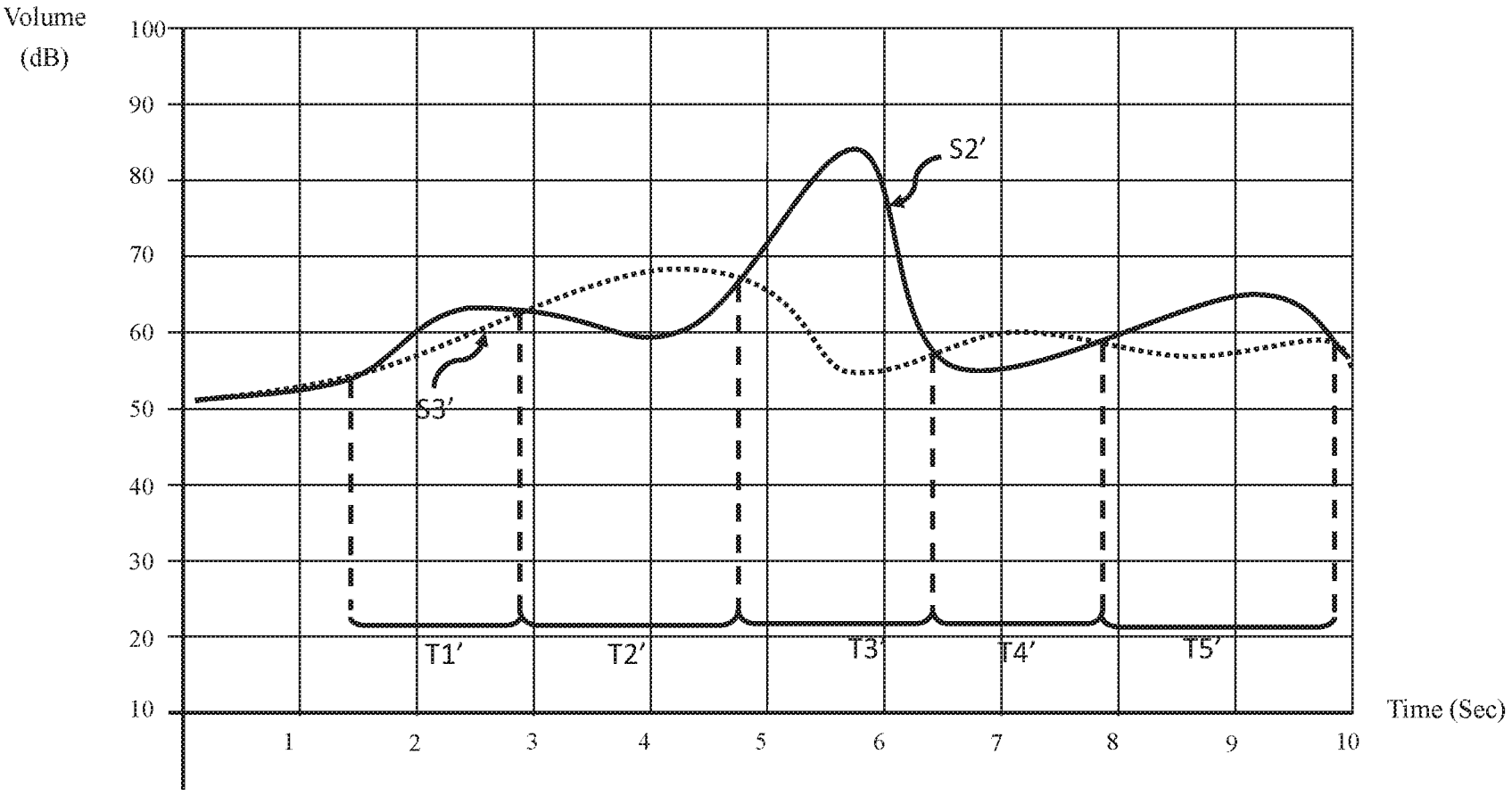
FIG. 3B is according to FIG. 2 and illustrates a schematic diagram showing the energy of the instant sound entropy value and the dynamic sound average entropy value of the ambient sound in a frequency band of 4000 Hz.

Please also refer to FIG. 2 for a schematic diagram of a frequency spectrum of ambient sound in different frequency bands according to an embodiment of the present invention; to FIG. 3A, which illustrates a schematic diagram showing the energy of the instant sound entropy value and the dynamic sound average entropy value of the ambient sound in a frequency band of 125 Hz according to FIG. 2; and to FIG. 3B, which illustrates a schematic diagram showing the energy of the instant sound entropy value and the dynamic sound average entropy value of the ambient sound in a frequency band of 4000 Hz according to FIG. 2.

Suppose that the ambient sound S1 is divided into a plurality of frequency bands of 32 Hz, 64 Hz, 125 Hz, 250 Hz, 500 Hz, 1000 Hz, 2000 Hz, 4000 Hz, 8000 Hz, and 16000 Hz, but the present invention is not limited to this division method. Taking FIG. 2 as an example, the ambient sound S1 has interference sounds at 125 Hz and 4000 Hz. The calculation module 40 defines that the interference sound should conform to the following condition: in a certain frequency band (such as 125 Hz or 4000 Hz in FIG. 2), an instant sound entropy value of the ambient sound S1 is greater than a dynamic sound average entropy value. The instant sound entropy value is a sound entropy value calculated in the current sampling time, and the sampling time may be between 0.1 seconds and 2 seconds. The dynamic sound average entropy value is an average entropy value of the sum of the previous instant sound entropy values. Therefore, after calculating each frequency band of the ambient sound S1, the computing module 40 can analyze the frequency band of the ambient sound S1 having the interference sound and the time period in which the interference sound appears.

Taking FIG. 3A as an example, the instant sound entropy curve S2 of the ambient sound S1 at 125 Hz is represented by a solid line in FIG. 3A, and the dynamic sound average entropy curve S3 is represented by a dotted line. The instant sound entropy curve S2 is the curve obtained by the computing module 40 calculating the ambient sound S1 in a certain frequency band and in the sampling time between 0.1 seconds and 2 seconds at a certain time point. The dynamic sound average entropy curve S3 at different time points will be changed with the average entropy value accumulated by the instant sound entropy curve S2 before the time point. The relationship between the two curves may be changed, so in FIG. 3A, it can be divided into time periods T1 to T5, wherein the instant sound entropy curve S2 is greater than the dynamic sound average entropy curve S3 in the time periods T1, T3, and T5, and the dynamic sound average entropy curve S3 is greater than the instant sound entropy curve S2 in the time periods T2 and T4. Therefore, the computing module 40 is able to obtain that the interference sound occurs in the time periods T1, T3, and T5 when the frequency band is 125 Hz.

In addition, the instant sound entropy curve S2' of the ambient sound S1 at the frequency band 4000 Hz is represented by the solid line of FIG. 3B, and the dynamic sound average entropy curve S3' is represented by the dotted line. In FIG. 3B, it can be divided into time periods T1 to T5, wherein the instant sound entropy curve S2' is greater than the dynamic sound average entropy curve S3' in the time periods T1', T3', and T5', and the dynamic sound average entropy curve S3' is greater than the instant sound entropy curve S2' in the time periods T2' and T4'. Therefore, the computing module 40 is able to obtain that the interference sound occurs in the time period T1', T3', and T5' when the frequency band is 4000 Hz.

The sound processing module 50 then processes the audio signal as a noise masking signal. The sound processing module 50 is electrically connected to the speaker module 20 and the computing module 40. The sound processing module 50 increases the energy of the noise masking signal in the interference sound frequency band and the time period such that the speaker module 20 amplifies the energy of the noise masking signal in the interference sound frequency band and the time period. Therefore, the sound processing module 50 increases the energy of the noise masking signal in the time periods T1, T3, and T5 at 125 Hz and also increases the noise masking signal in the time periods T1', T3', and T5' at 4000 Hz noise masking signal amplification so that the noise masking signal can mask the interference sound. The sound processing module 50 increases the energy gain of the noise masking signal by M times in the interference sound frequency bands and the time periods, wherein M≥(the instant sound entropy value divided by the dynamic sound average entropy value) and M≤30, but the present invention is not limited to this value range.

Figure 4:
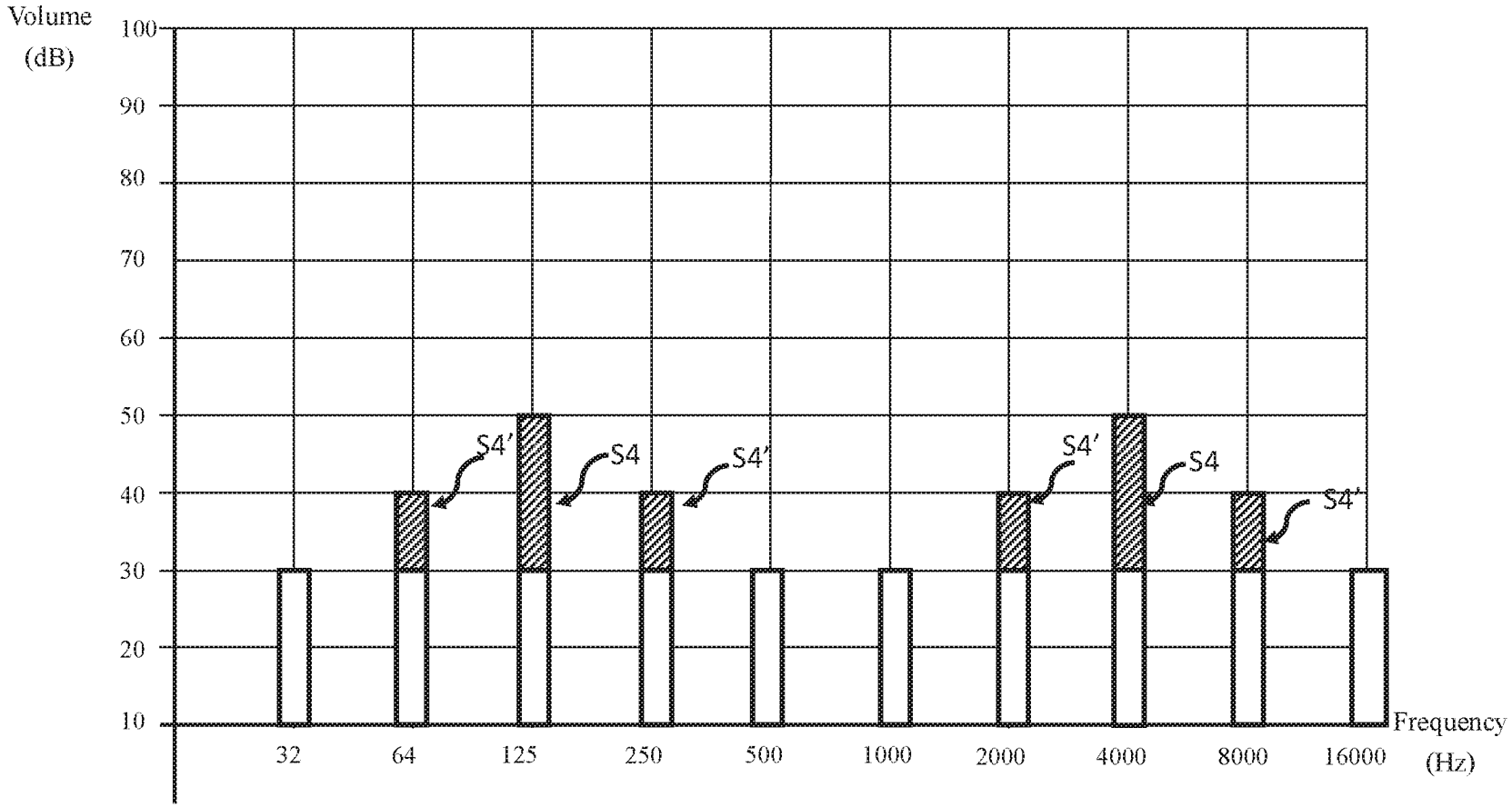
FIG. 4 is according to FIG. 2 and illustrates a schematic diagram of a frequency spectrum showing the energy adjustment of the noise masking signal of the embodiment of the present invention.

In addition, in the time period in which the interference sound exists, the sound processing module 50 can also increase the energy of the noise masking signal in each frequency side band of the interference sound frequency band, but the gain is smaller than that used by the processing module 50 to increase the energy of the noise masking signal in the interference sound frequency band, as shown in FIG. 4, which illustrates a schematic diagram of a frequency spectrum showing the energy adjustment of the noise masking signal according to an embodiment of the present invention.

The computing module 40 finds interference sounds at 125 Hz and 4000 Hz, and the sound processing module 50 obtains that the interference sound frequency bands are in the time periods T1, T3, and T5, so the sound processing module 50 increases the energy of the noise masking signal S4 at the 125 Hz and 4000 Hz frequency bands of the ambient sound S1 during the time periods T1, T3, and T5, and also increases an energy of a sub-noise masking signal S4' at the 64 Hz, 250 Hz, 2000 Hz, and 8000 Hz frequency bands, wherein the energy of the sub-noise masking signal S4' is smaller than the energy of the noise masking signal S4.

It is noted that each module of the sound playback device 10 can be a hardware device, a software program combined with a hardware device, a firmware combined with a hardware device, etc.; for example, a computer program product can be stored in a computer readable medium to be read and executed to achieve the functions of the present invention, but the present invention is not limited to the above-mentioned configurations. In addition, the present embodiment is merely illustrative of preferred embodiments of the present invention, and in order to avoid redundancy, not all possible combinations of variations are described in detail. However, those skilled in the art will appreciate that the various modules or components described above are not necessarily required. In order to implement the invention, other well-known modules or elements of more detail may also be included. Each module or component may be omitted or modified as needed, and any other modules or components may exist between any two modules.

Figure 5:
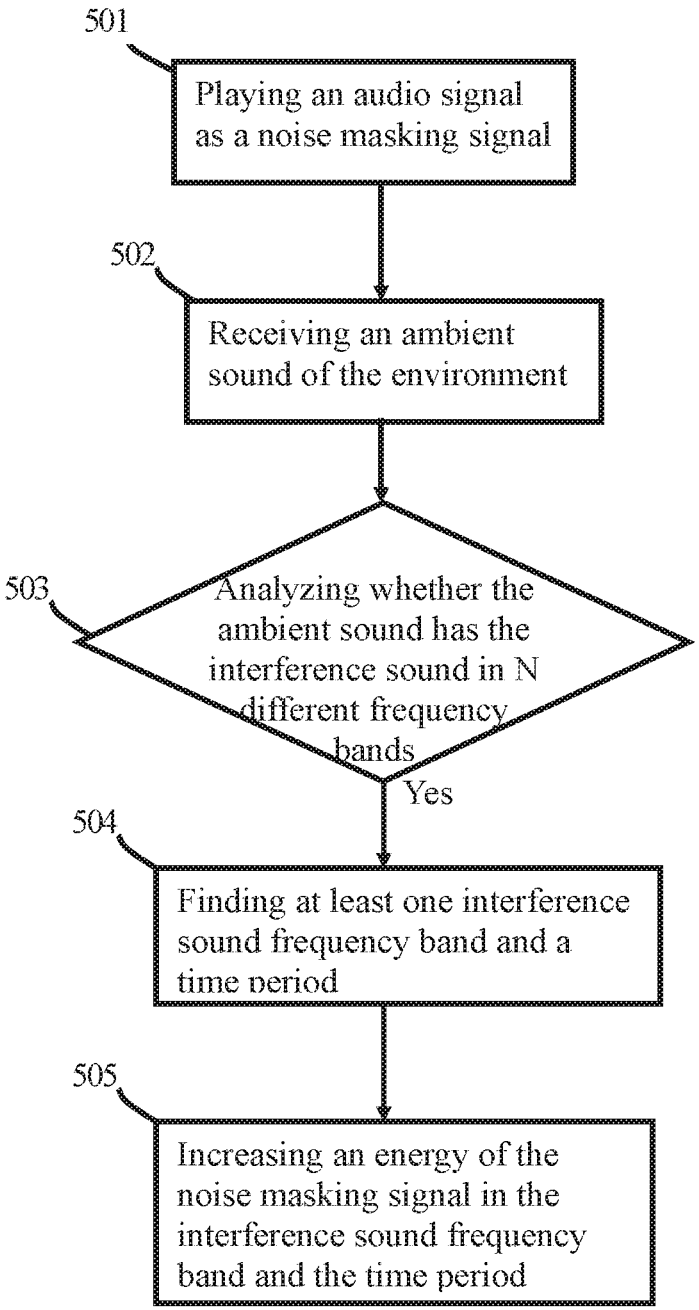
FIG. 5 illustrates a flow chart showing the steps of the method for masking an interference sound through a noise masking signal of the present invention.

Next, please refer to FIG. 5, which illustrates a flow chart showing the steps of the method for masking an interference sound through a noise masking signal according to the present invention. It is noted that, in the following description, the sound playback device 10 of the present invention is used as an example to illustrate the method for masking the interference sound by the noise masking signal of the present invention. However, the method for masking the interference sound by the noise masking signal of the present invention is not limited to use with the sound playback device 10 of the same structure as described above.

First, the sound playback device 10 proceeds to step 501: playing an audio signal as a noise masking signal.

First, the sound playback device 10 uses the speaker module 20 to play an audio signal as a noise masking signal.

At the same time, the method proceeds to step 502: receiving an ambient sound of the environment.

At the same time, the sound receiving module 30 receives an ambient sound of the environment.

Then the method proceeds to step 503: analyzing whether the ambient sound has an interference sound in N different frequency bands.

Then the computing module 40 analyzes whether the ambient sound has an interference sound in N different frequency bands, wherein N can be greater or equal to 5 but less than or equal to 1000, but the invention does not limit the number of frequency band splits.

If an interference sound is identified, the computing module 40 proceeds to step 504: finding at least one interference sound frequency band and a time period.

At this time, the computing module 40 finds a frequency band having an interference sound in the ambient sound and the time period of the interference sound in this frequency band. Therefore, the computing module 40 analyzes each frequency band of the ambient sound S1 and finds a certain frequency band of the ambient sound S in a time period that conforms to the following condition: the instant sound entropy value is greater than the dynamic sound average entropy value. Then the frequency band and the time period of the interference sound are identified.

Then the method proceeds to step 505: increasing an energy of the noise masking signal in the interference sound frequency band and the time period.

Finally, the sound processing module 50 can increase the energy of the noise masking signal S4 in the interference sound frequency band and the time period to amplify the energy of the noise masking signal S4 to mask the interference sound in the frequency band and the time period. The sound processing module 50 increases the energy gain of the noise masking signal by M times in the interference sound frequency band and the time period, wherein M≥(the instant sound entropy value divided by the dynamic sound average entropy value), and M≤30, but the invention is not limited to this value. In the time period in which the interference sound exists, the sound processing module 50 can also increase the energy of the sub-noise masking signal S4' in each frequency band on both sides of the interference sound frequency band, but the energy of the sub-noise masking signal S4' is smaller than the energy of the noise masking signal S4 in the interference sound frequency band. Therefore, the speaker module 20 can play the noise masking signal S4 and the sub-noise masking signal S4' with amplified energy to mask the interference sound.

It is noted that the method for masking the interference sound by the noise masking signal of the present invention is not limited to the above-described order of steps and that the order of the above steps may be changed as long as the object of the present invention can be achieved.

It can be seen from the above description that, according to the above embodiment, when the user uses the sound playback device 10, the user can determine whether the interference sound exists by calculating the sound entropy values of different frequency bands, thereby adjusting the energy of the noise masking signal of different frequency bands and time period to mask the interference sound more efficiently.

It is noted that the described embodiments are only for illustrative and exemplary purposes and that various changes and modifications may be made to the described embodiments without departing from the scope of the invention as disposed by the appended claims.

What is claimed is:

1. A method for masking an interference sound through a noise masking signal for using with a sound playback device so that a user can use the sound playback device in an environment, the method comprising the following steps of:

playing an audio signal as the noise masking signal;

receiving an ambient sound of the environment;

analyzing whether the ambient sound has an interference sound in N different frequency bands;

if so, finding at least one interference sound frequency band and a time period, wherein 5≤N≤1000, and the interference sound conforms to:

an instant sound entropy value of the ambient sound in the interference sound frequency band is greater than a dynamic sound average entropy value, wherein:

the instant sound entropy value is the calculated sound entropy value in a current sampling time, wherein the sampling time is between 0.1 seconds and 2 seconds; and the dynamic sound average entropy value is an average entropy value of the sum of the previous instant sound entropy values; and increasing an energy of the noise masking signal in the interference sound frequency band and the time period.

2. The method for masking the interference sound through a noise masking signal as claimed in claim 1, further comprising the following steps of:

increasing the energy of the noise masking signal by a gain of M times in the interference sound frequency band and the time period, wherein M≥(the instant sound entropy value divided by the dynamic sound average entropy value).

3. The method for masking the interference sound through a noise masking signal as claimed in claim 2, wherein M≤30.

4. The method for masking the interference sound through a noise masking signal as claimed in claim 1, further comprising the following steps of:

during the time period of the interference sound, increasing an energy of a sub-noise masking signal on both side bands of the interference sound frequency band, wherein the energy of the sub-noise masking signal is less than the energy of the noise masking signal increased in the interference sound frequency band.

5. A sound playback device for a user to use the sound playback device in an environment, the sound playback device comprising:

a speaker module for playing an audio signal as a noise masking signal;

a sound receiving module for receiving an ambient sound of the environment;

a computing module electrically connected to the sound receiving module and provided for analyzing whether the ambient sound has an interference sound in N different frequency bands; if so, finding at least one interference sound frequency band and a time period, wherein $5 \leq N \leq 1000$, and the interference sound conforms to:

an instant sound entropy value of the ambient sound in the interference sound frequency band is greater than a dynamic sound average entropy value, wherein:

the instant sound entropy value is the calculated sound entropy value in a current sampling time, wherein the sampling time is between 0.1 seconds and 2 seconds; and the dynamic sound average entropy value is an average entropy value of the sum of the previous instant sound entropy values; and a sound processing module electrically connected to the computing module and the speaker module for increasing an energy of the noise masking signal in the interference sound frequency band and the time period, causing the speaker module to amplify the energy of the noise masking signal in the interference sound frequency band and the time period.

6. The sound playback device as claimed in claim 5, wherein the sound processing module increases the energy of the noise masking signal by a gain of M times in the interference sound frequency band and the time period, wherein $M \geq$(the instant sound entropy value divided by the dynamic sound average entropy value).

7. The sound playback device as claimed in claim 6, wherein $M \leq 30$.

8. The sound playback device as claimed in claim 5, wherein the sound processing module increases an energy of a sub-noise masking signal in both side bands of the interference sound frequency band during the time period of the interference sound, wherein the energy of the sub-noise masking signal is less than the energy of the noise masking signal increased in the interference sound frequency band.

* * * * *